US005806352A

United States Patent [19]

Axford

[11] Patent Number: 5,806,352

[45] Date of Patent: Sep. 15, 1998

[54] LOCKING BRACKET

[76] Inventor: Norman Axford, 12 Tucker Street, Bass Hill, Australia, 2197

[21] Appl. No.: 776,894

[22] PCT Filed: Jul. 19, 1995

[86] PCT No.: PCT/AU95/00438

§ 371 Date: Apr. 17, 1997

§ 102(e) Date: Apr. 17, 1997

[87] PCT Pub. No.: WO96/02719

PCT Pub. Date: Feb. 1, 1996

[30] Foreign Application Priority Data

Jul. 19, 1994 [AU] Australia ..... PM6910

[51] Int. Cl.[6] ..... E05B 67/38

[52] U.S. Cl. ..... 70/56; 70/54; 70/416; 70/95

[58] Field of Search ..... 70/95, 52–56, 70/416, 417

[56] References Cited

U.S. PATENT DOCUMENTS

| | | | |
|---|---|---|---|
| 1,244,404 | 10/1917 | Ankovitz | 70/56 |
| 3,559,429 | 2/1971 | Hermann | 70/56 X |
| 3,828,591 | 8/1974 | Beaver | 70/56 |
| 3,858,923 | 1/1975 | Bunn | 70/52 X |
| 3,968,985 | 7/1976 | Nielsen, Jr. | 292/340 |
| 4,031,719 | 6/1977 | Klingler | 292/57 |
| 4,238,941 | 12/1980 | Halopoff | 70/56 |
| 4,307,904 | 12/1981 | Daus | 70/56 X |
| 4,458,510 | 7/1984 | Nielsen | 70/56 X |
| 4,566,296 | 1/1986 | Kochakis | 70/56 |
| 4,718,259 | 1/1988 | Appelbaum | 70/52 X |
| 4,854,618 | 8/1989 | Webster | 292/224 |
| 4,877,275 | 10/1989 | DeForrest, Sr. | 70/56 X |
| 4,893,855 | 1/1990 | Itakura | 292/341.17 |
| 4,896,518 | 1/1990 | Appelgren | 70/56 X |
| 5,163,308 | 11/1992 | Lillo | 70/56 X |
| 5,174,135 | 12/1992 | Loughlin | 70/56 X |
| 5,219,384 | 6/1993 | Elsfelder et al. | 70/56 X |
| 5,321,961 | 6/1994 | Barberi | 70/56 |
| 5,426,959 | 6/1995 | Kies | 70/56 |
| 5,469,722 | 11/1995 | Ellefsen | 70/56 |
| 5,477,710 | 12/1995 | Stefanutti | 70/56 |

FOREIGN PATENT DOCUMENTS

| | | | |
|---|---|---|---|
| A-35184/93 | 10/1993 | Australia . | |
| 857594 | 12/1990 | Canada | 70/56 |
| 0 370 893 | 5/1990 | European Pat. Off. . | |
| 1011308 | 6/1952 | France . | |
| 2130286 | 5/1984 | United Kingdom . | |
| 2270951 | 3/1994 | United Kingdom . | |

*Primary Examiner*—Suzanne Dino Barrett
*Attorney, Agent, or Firm*—Buchanan Ingersoll, P.C.

[57] ABSTRACT

A locking bracket (1) includes a 3 mm mild steel plate (2) having two opposed longitudinally extending edges (3, 4) and two opposed transversely extending edges (5, 6). A locking formation in the form of an upstanding protrusion (7) is welded to plate (2) for selectively captively retaining a locking device such as a padlock (8). An aperture (10) in plate (2) is longitudinally spaced apart from protrusion (7) for receiving a bolt (11) which extends from padlock (8). In use, bolt (11) passes through aperture (10) and like apertures formed in a first and a second article which are to be locked.

6 Claims, 2 Drawing Sheets

LOCKING BRACKET

TECHNICAL FIELD

The present invention relates to a lock and in particular to a locking bracket.

The invention has been developed primarily for locking roller shutters and will be described hereinafter with reference to that application. However, the invention is not limited to that particular field of use and is also suitable for locking swinging doors, sliding doors, tilt-a-doors, windows and the like.

BACKGROUND ART

Hitherto, the secure locking of roller shutters has involved securing locking devices to the base of the shutter for subsequent selective retention to a loop, eyelet or other protrusion extending upwardly from the floor. These methods of locking are inconvenient because the floor located protrusions provide an obstacle particularly to persons walking through the opening provided. Additionally the locking devices prevent complete retraction of the shutter. This is especially disadvantageous in retail outlets where convenience and aesthetics are of paramount importance.

DISCLOSURE OF THE INVENTION

It is an object of the present invention, at least in the preferred embodiment, to overcome or substantially ameliorate at least one of these deficiencies of the prior art.

According to one aspect of the invention there is provided a locking bracket including a plate, a locking formation supported by the plate for selectively captively engaging a locking device, and an aperture in the plate spaced apart from the formation for receiving a bolt extending from the locking device, wherein, in use, the bolt passes through the aperture and a first and second article which are to be locked, the plate being disposed intermediate the first and a second articles.

Preferably, a shroud extends substantially perpendicularly from at least one edge of the plate for shielding the locking device and/or the locking formation.

According to another aspect of the invention there is provided a locking bracket including a plate, a locking formation supported by the plate for selectively and captively engaging a locking device, an aperture in the plate spaced apart from the locking formation for receiving a bolt extending from the locking device, and a shroud extending substantially perpendicularly from at least one edge of the plate for shielding the locking device.

Preferably, the shroud extends from two opposed edges of the plate and also shields the locking formation.

Preferably also, the locking formation and the aperture are longitudinally spaces apart and the shroud extends from two opposed longitudinally extending edges of the plate, the shroud including slots adjacent to respective edge of the plate for facilitating placement of the bracket between a first and a second article to be locked.

BRIEF DESCRIPTION OF THE DRAWINGS

A preferred embodiment of the invention will now be described, by way of example only with reference to the accompanying drawings in which.

MODE FOR CARRYING OUT THE INVENTION

Figure 2:
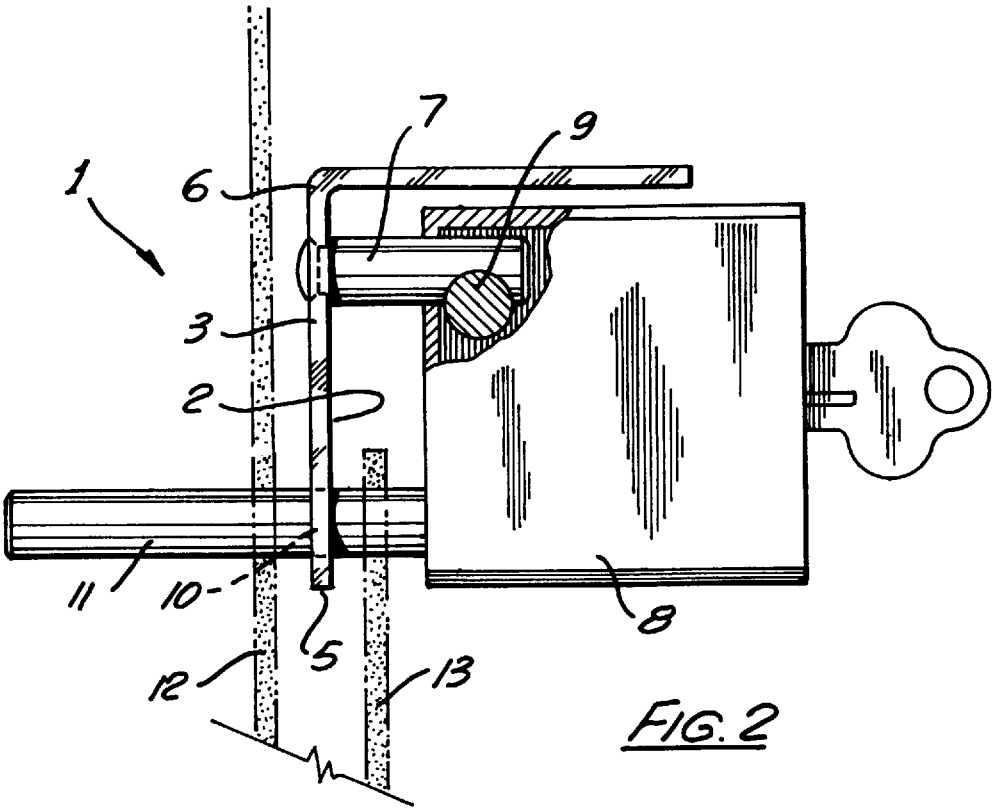
FIG. 2 is a aide view of the bracket of FIG. 1, in situ.
Figure 1:
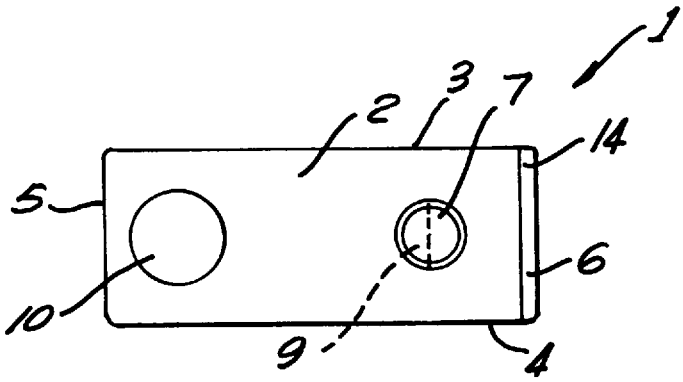
FIG. 1 is a top view of a locking bracket according to one aspect of the invention.

Referring to FIGS. 1 and 2, a locking bracket 1 includes a 3 mm mild steel plate 2 having two, opposed longitudinally extending edges 3 and 4 and two opposed transversely extending eyes 5 and 6. A locking formation in the form of an upstanding protrusion 7 is welded to place 2 for selectively captively retaining a locking device such as a padlock 8. An aperture 10 in plate 2 is longitudinally spaced apart from protrusion 7 for receiving a bolt 11 which extends from padlock 8. In use, bolt 11 passes through aperture 10 and like apertures formed in a first and a second article which are to be locked. In FIG. 2 the first and second articles are a roller shutter 12 and a channel 13 along which shutter 12 slides.

Protrusion 7 includes a locking slot 9 for co-operating with padlock 8 to effect locking. Alternative embodiments include a differently shaped slot for co-operating with other locks.

A shroud 14 extends perpendicularly away from edge 6 of plate 2 to shield padlock 8 and protrusion 7 from either intentional or inadvertant damage.

Preferably, bracket 1, in use, is disposed intermediate shutter 12 and channel 13, although in some circumstances plate 2 and padlock 8 straddle the articles being locked. Preferably also, bracket 1 is used near the base of shutter 12 whereby bolt 11 extends through one of the more substantive structural elements of the shutter.

When not in use, bracket 1 and padlock 8 can be completely removed from the shutter and channel for facilitating unimpeded operation of the shutter.

Figure 5:
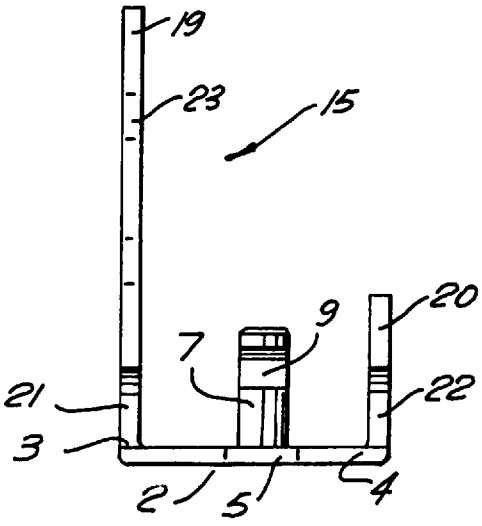
FIG. 5 is a side view of the bracket of FIG. 4.
Figure 4:
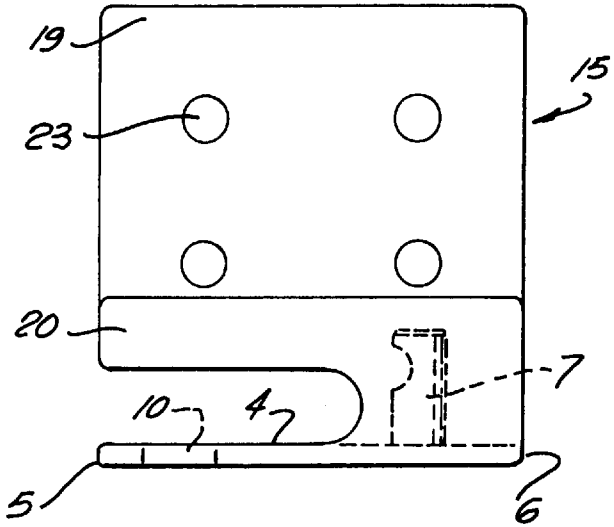
FIG. 4 in a front view of a locking bracket formed from the sheet of FIG. 3.
Figure 3:
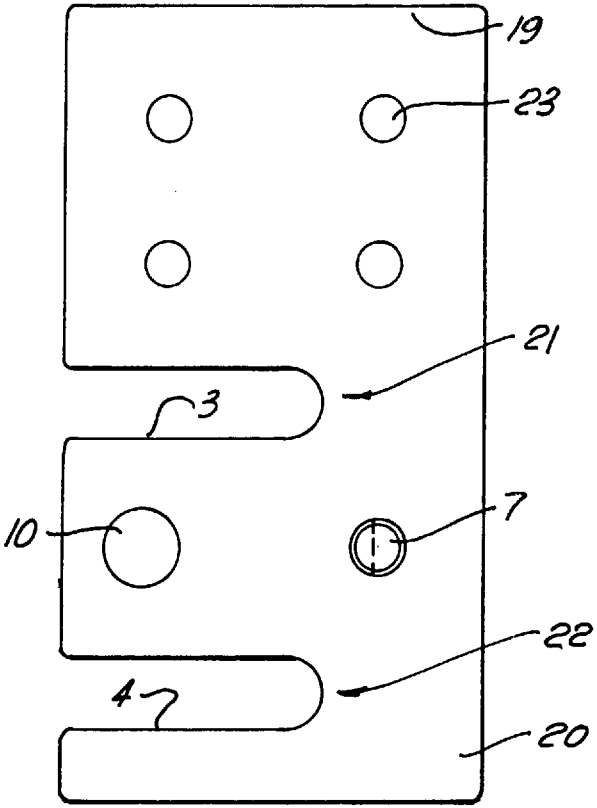
FIG. 3 is a top view of a punched metal sheet from which a second embodiment of the invention is produced.

An alternative locking bracket 15 is illustrated in FIGS. 3 to 5 where corresponding features are denoted by corresponding reference numerals. In this embodiment, plate 2 includes two shrouds 19 and 20 which extend perpendicularly away from edges 3 and 4 respectively for providing increased protection to padlock 8 and protrusion 7.

Both shrouds 19 and 20 include opposed longitudinally extending slots 21 and 22 adjacent to respective edges 3 and 4. These slots facilitate placement of bracket 15 between first and second articles. For example, bracket 15 can be used similarly to bracket 1 for locking stutter 12 to channel 13.

In alternative embodiments bracket 15 does not include slots 21 and 22.

Shroud 19 includes a plurality of spaced apart holes 23 arranged in a square configuration for allowing attachment of bracket 15 to an article such as a door or window frame. Holes 23 can be in alternative configurations or be of a different shape, if required.

Both brackets 1 and 15 accept a commercially available padlock 8, although the spacing between protrusion 7 and aperture 11 can be varied to accept locks of different sizes or configurations. One embodiment of the invention includes a plate 2 having a number of apertures 10 for selectively allowing one of a plurality of different locks to be used.

Plate 2 and shrouds 14, 19 and 20 are preferably integrally formed by stamping and forming a flat steel sheet. Alternatives are known to those skilled in the art of metal fabrication. Moreover, some applications may require different thicknesses or quality of steel. For example, some embodiments utilise hardened steel.

Aperture 10, in sore embodiments, is in the form of a longitudinally extending slot to selectively accommodate the shackles of differently sized padlocks.

The invention provides a convenient locking bracket which is easily adapted for locking articles. The only modifications which may be required are the inclusion in the articles of appropriate holes for bolt 11.

Although the invention has been described with reference to specific examples, it will be appreciated by those skilled in the art that the invention may be embodied in many other forms.

I claim:

1. A locking bracket including a plate, a locking formation in the form of an upstanding protrusion supported by said plate for selectively captively engaging a locking device, a shroud extending generally perpendicularly from at least one edge of said plate and shielding at least a portion of said upstanding protrusion, and an aperture in said plate spaced apart from said formation for receiving a bolt extending from said locking device, wherein, in use, said bolt passes through said aperture and a first and a second article which are to be locked, said plate being disposed intermediate said first and second article.

2. A locking bracket according to claim 1 including a shroud extending substantially perpendicularly from at least one edge of said plate for shielding said locking device and/or said locking formation.

3. A locking bracket including a plate, a locking formation in the form of an upstanding protrusion supported by the plate for selectively and captively engaging a locking device, an aperture in said plate spaced apart from the locking formation for receiving the bolt extending from the locking device, and a shroud extending substantially perpendicularly from at least one edge of said plate and shielding at least a portion of said locking device.

4. A locking bracket according to claim 3 wherein said shroud extends from two opposed edges of said plate and also shields said locking formation.

5. A locking bracket according to claim 4 wherein said locking formation and said aperture are longitudinally spaced apart and said shroud extends from two opposed longitudinally extending edges of said plate, said shroud including slots adjacent to respective edges of said plate for facilitating placement of said bracket between a first and a second article to be locked.

6. A locking bracket according to one of the preceding claims wherein said aperture is a slot for selectively accommodating different sized locking devices.

* * * * *